US012467331B1

(12) United States Patent
Doran et al.

(10) Patent No.: US 12,467,331 B1
(45) Date of Patent: Nov. 11, 2025

(54) LOW TORQUE ACTUATED TUBING HANGER ORIENTATION

(71) Applicant: FMC Kongsberg Subsea AS, Kongsberg (NO)

(72) Inventors: Thomas Doran, Kongsberg (NO); Graham Ford, Holmestrand (NO); Alexey Voronezhev, Oslo (NO); Marcel Rozek, Cracow (PL); Frank Wergeland, Erdal (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 18/906,791

(22) Filed: Oct. 4, 2024

(51) Int. Cl.
*E21B 33/06* (2006.01)
*E21B 33/04* (2006.01)

(52) U.S. Cl.
CPC ..... *E21B 33/04* (2013.01); *E21B 33/06* (2013.01)

(58) Field of Classification Search
CPC .. E21B 23/0416; E21B 23/0422; E21B 33/06; E21B 33/04
See application file for complete search history.

(56) References Cited

U.S. PATENT DOCUMENTS 5,429,188 A * 7/1995 Cameron ..... E21B 33/0415 166/117.7
6,725,924 B2 4/2004 Davidson et al.
6,834,717 B2 * 12/2004 Bland ..... E21B 33/0415 166/92.1
7,114,571 B2 10/2006 Gatherar et al.
8,763,708 B2 * 7/2014 Travis ..... E21B 33/0415 166/85.5
9,222,321 B2 12/2015 Nellessen, Jr. et al.
10,138,699 B2 * 11/2018 Nguyen ..... E21B 33/0415
10,422,196 B2 9/2019 Levert, Jr. et al.
10,837,251 B2 11/2020 Foley et al.
11,015,412 B2 5/2021 Robottom et al.
11,180,968 B2 * 11/2021 Mitchell ..... E21B 33/043
2002/0000315 A1 1/2002 Kent et al.
2004/0104024 A1 6/2004 Kent et al.
2004/0140124 A1 7/2004 Fenton et al.
2015/0259990 A1 9/2015 June
2018/0179839 A1 6/2018 Nguyen
2021/0310327 A1 10/2021 Szpunar et al.
2024/0068360 A1 * 2/2024 Farquharson ..... E21B 33/03
2024/0426187 A1 12/2024 Spitz et al.

OTHER PUBLICATIONS

U.S. Appl. No. 18/906,512, Non-Final Office Action issued Aug. 11, 2025.

* cited by examiner

*Primary Examiner* — Kenneth L Thompson
(74) *Attorney, Agent, or Firm* — Erise IP, P.A.

(57) ABSTRACT

Systems, methods, and devices for blowout preventer independent alignment and installation of a tubing hanger within a subsea well system. A tubing hanger orientation assembly may be included with a rotary actuator that provides low torque adjustment and fine alignment of the tubing hanger with respect to other subsea equipment. At least one sensor may be included to measure and confirm an orientation of the tubing hanger for proper alignment and connection to a subsea wellhead.

20 Claims, 10 Drawing Sheets

LOW TORQUE ACTUATED TUBING HANGER ORIENTATION

BACKGROUND

1. Field

Embodiments of the present disclosure relate to subsea well systems. More specifically, embodiments of the present disclosure relate to tubing hanger orientation equipment for subsea well systems.

2. Related Art

In subsea well systems, such as, a vertical in the well (V-ITW) system, tubing hanger assemblies are typically installed using a tubing hanger orientation joint together with a BOP pin to orient them correctly relative to the template structure or permanent guide base (PGB). Rotation is achieved by lifting a string using a top drive component causing the BOP pin to interact against a helical interface on the string. Typical installation techniques calibrate the tubing hanger orientation joint prior to running the tubing hanger assembly subsea and then rely on the tubing hanger orientation joint and BOP pin to correctly orient the tubing hanger. However, there is no way of confirming proper alignment until after BOP removal. Accordingly, if the tubing hanger is not properly aligned, rerunning completion or modification of the tree may be needed.

Further, current techniques of measuring the orientation of the tubing hanger assembly and associated components rely on interface data and a complicated tolerance loop with limited repeatability. Current techniques are also not capable of measuring tubing hanger orientation independently of a blowout preventer assembly.

SUMMARY

Embodiments of the present disclosure may solve the above-mentioned problems by providing subsea rotational adjustment equipment operable to provide accurate and repeatable low torque and fine alignment after initial landing of a tubing hanger and tubing hanger orientation assembly. Further, embodiments of the present disclosure provide accurate measurement of the tubing hanger rotational orientation independent of other subsea equipment.

In some aspects, the techniques described herein relate to a tubing hanger orientation assembly for coupling a tubing hanger assembly to a wellhead, the tubing hanger orientation assembly including: an internal joint structure operable to be placed within an internal bore of a blowout preventer (BOP) associated with the wellhead; a sleeve structure disposed around the internal joint structure; a rotary actuator that interfaces with the sleeve structure, the rotary actuator operable to drive rotation of the sleeve structure with respect to the internal joint structure; a coupling component operable to lock the sleeve structure to the internal joint structure such that rotation of the sleeve structure with respect to the internal joint structure is prevented; a reaction point that interfaces with the BOP for rotation of the internal joint structure with respect to the BOP; and at least one orientation sensor operable to measure a rotational orientation of the tubing hanger assembly.

In some aspects, the techniques described herein relate to a tubing hanger orientation assembly for coupling a tubing hanger assembly to a wellhead, the tubing hanger orientation assembly including: an internal joint structure operable to be placed within an internal bore of a blowout preventer (BOP) associated with the wellhead; a sleeve structure disposed around the internal joint structure; a rotary actuator that interfaces with the sleeve structure, the rotary actuator operable to drive rotation of the sleeve structure with respect to the internal joint structure; a coupling component operable to lock the sleeve structure to the internal joint structure such that rotation of the sleeve structure with respect to the internal joint structure is prevented; a brake disposed on the sleeve structure, the brake operable to interface with a portion of the BOP; and at least one orientation sensor operable to measure a rotational orientation of the tubing hanger assembly.

In some aspects, the techniques described herein relate to a tubing hanger orientation assembly for coupling a tubing hanger assembly to a wellhead, the tubing hanger orientation assembly including: an internal joint structure operable to be placed within an internal bore of a blowout preventer (BOP) associated with the wellhead; a sleeve structure disposed around the internal joint structure, the sleeve structure including an internal gear element with a plurality of gear teeth disposed along an internal surface of the sleeve structure; a rotary actuator that interfaces with the internal gear element of the sleeve structure, the rotary actuator operable to drive rotation of the sleeve structure with respect to the internal joint structure; a BOP pin receiving structure that interfaces with a BOP pin of the BOP, thereby providing a reaction point for rotation of the internal joint structure with respect to the BOP; and at least one orientation sensor operable to measure a rotational orientation of the tubing hanger assembly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

BRIEF DESCRIPTION OF THE DRAWING FIGURES

Embodiments of the present disclosure are described in detail below with reference to the attached drawing figures, where:

Figure 1:
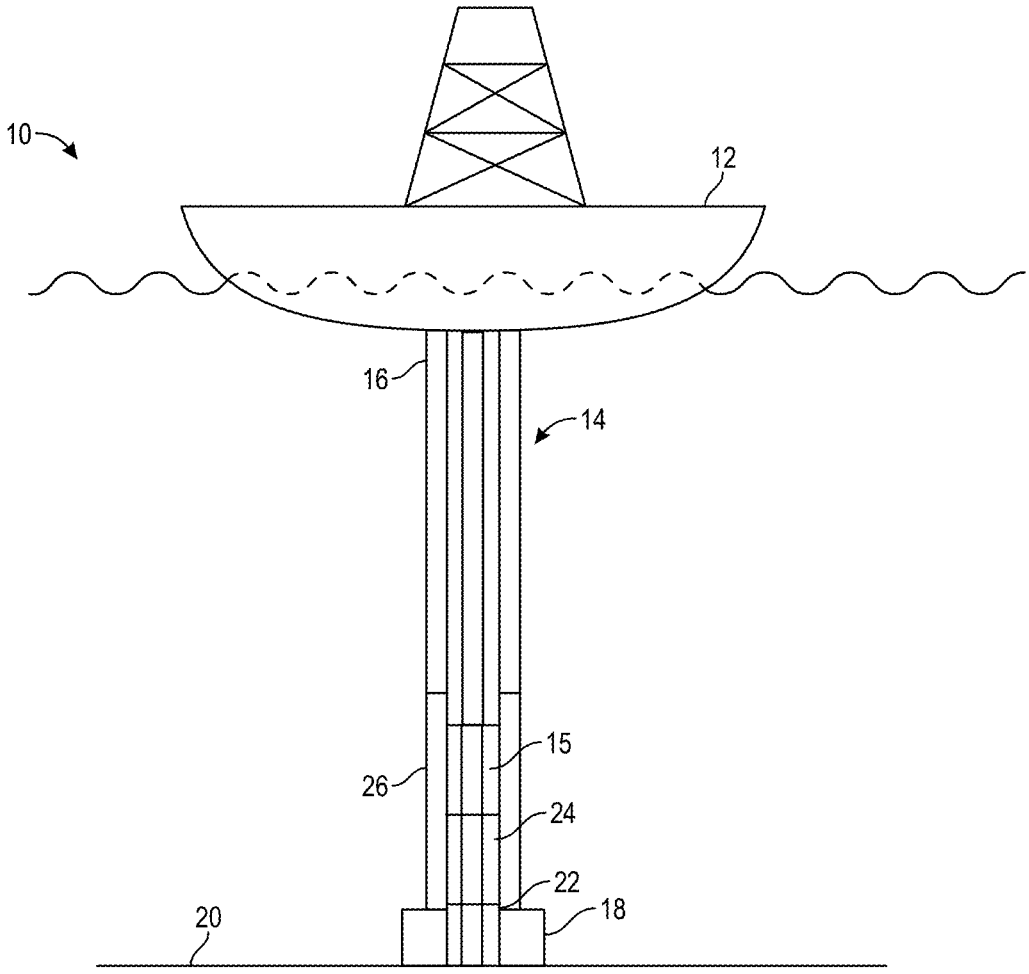
FIG. 1 illustrates an exemplary subsea well system relating to some embodiments of the present disclosure.

The drawing figures do not limit the present disclosure to the specific embodiments disclosed and described herein. The drawings are not necessarily to scale, emphasis instead being placed upon clearly illustrating the principles of the present disclosure.

DETAILED DESCRIPTION

The following detailed description references the accompanying drawings that illustrate specific embodiments in which the present disclosure can be practiced. The embodiments are intended to describe aspects of the present disclosure in sufficient detail to enable those skilled in the art to practice the present disclosure. Other embodiments can be utilized, and changes can be made without departing from the scope of the present disclosure. Therefore, the following detailed description is not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc., described in one embodiment may also be included in other embodiments but is not necessarily included. Thus, the technology can include a variety of combinations and/or integrations of the embodiments described herein.

Embodiments of the present disclosure relate to tubing hanger orientation equipment to install a tubing hanger assembly within a subsea well system and attach the tubing hanger assembly to a wellhead. A low torque motor assembly or other low-torque rotary actuation system may be used to provide post-landing adjustment and fine alignment of the tubing hanger responsive to an orientation verification from at least one sensor, such as a gyroscopic sensor. In some embodiments, additional gyroscopic sensors such as one or more external gyroscopes may be used as a reference for the at least one sensor. Prior art methods of tubing hanger orientation typically rely on a helix and blowout preventer (BOP) pin interface to orient the tubing hanger and thus, are unable to provide fine alignment adjustment and adjusting after initial landing of the tubing hanger. Further, prior art methods may utilize topside equipment such as a top drive to provide rough orientation by vertically displacing a string assembly to activate a BOP interface but do not provide any means for fine alignment.

FIG. 1 illustrates an exemplary subsea well system 10 relating to some embodiments of the present disclosure. In some embodiments, a surface platform 12, such as a mobile vessel or permanent structure, is included disposed at surface level above the subsea well system 10. A string assembly 14 may be coupled to the surface platform 12. For example, the string assembly 14 may include a tubing string or landing string 15 configured to be placed within a riser structure 16 and lowered to a wellhead 18 at seabed 20, as shown.

In some embodiments, a tubing hanger 22 is lowered to the wellhead 18 for coupling to the wellhead 18. For example, the tubing hanger 22 is lowered down to the wellhead 18 through a bore of the string assembly 14 and positioned using a tubing hanger running tool 24. In some embodiments, the subsea well system 10 further comprises a blowout preventer (BOP) 26, a BOP stack, or a BOP assembly for preventing leaking and for monitoring and controlling aspects of the subsea well system 10. In some embodiments, the landing string 15 is included above the tubing hanger running tool 24, as shown.

In some embodiments, the BOP 26 is coupled to the wellhead 18, for example, using any combination of fasteners or other connecting components. The BOP 26 may include a BOP stack with a plurality of blowout prevent components. In some embodiments, the tubing hanger 22 and the tubing hanger running tool 24 are lowered to the wellhead 18 through an internal bore of the BOP 26, as shown. As will be described in further detail below, interfacing with the BOP 26 may be used to provide a reaction point for rotating and aligning the tubing hanger running assembly to position the tubing hanger 22 with respect to the wellhead 18 and other components.

In some embodiments, the tubing hanger 22 is configured to be coupled to a subsea tree after installation of the tubing hanger 22. As such, the tubing hanger 22 orientation with respect to other components of the subsea well system 10 may be predetermined to interface with a predetermined orientation for the subsea tree. For example, a predetermined orientation and positioning of the subsea tree may ensure that a production outlet of the subsea tree properly interfaces with other components such as a subsea manifold and connections therebetween. Further, the subsea tree orientation may be determined to interface with other components disposed on the seabed.

In some embodiments, a number of additional components not explicitly shown may be included within the subsea well system 10. For example, any combination of additional subsea trees, manifolds, tubing structures, risers, and other subsea components may be included.

Figure 2:
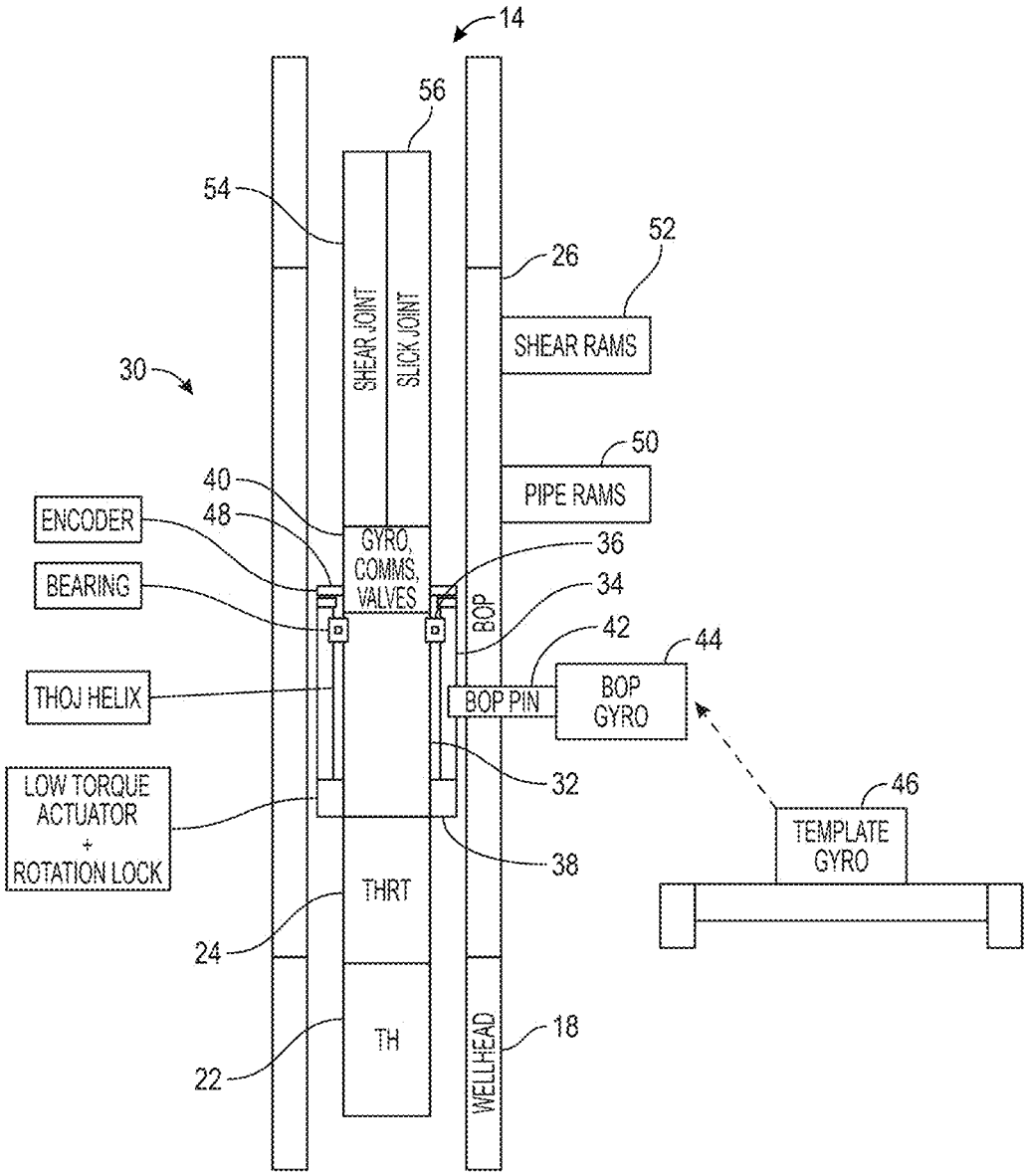
FIG. 2 illustrates an exemplary tubing hanger orientation system relating to some embodiments of the present disclosure.

FIG. 2 illustrates an exemplary tubing hanger orientation system 30 relating to some embodiments of the present disclosure. In some embodiments, the tubing hanger orientation system 30 interfaces with components of the subsea well system 10 described above. For example, the tubing hanger orientation system 30 may interface with portions of the wellhead 18 and BOP 26, as shown. The tubing hanger orientation system 30 may be used to lower the tubing hanger 22 and position within the BOP 26 for installation and coupling with the wellhead 18. For example, the tubing hanger running tool 24 and tubing hanger 22 are lowered with the string assembly 14 and run through an internal bore of the BOP 26 for coupling with the wellhead 18.

In some embodiments, the tubing hanger orientation system 30 comprises an internal joint structure 32. The internal joint structure 32 may include a substantially cylindrical and longitudinal shape. For example, in some embodiments, the internal joint structure 32 includes an inner mandrel portion that is part of or coupled to the string assembly 14. In some embodiments, the tubing hanger orientation system 30 further includes a sleeve structure 34. The sleeve structure 34 may be disposed around the internal joint structure 32, and, in some embodiments, is independently rotatable from the internal joint structure 32. However, embodiments are contemplated with alternate shapes and structural portions.

In some embodiments, one or more bearings 36 are included in the tubing hanger orientation system 30. For example, in some embodiments, at least one bearing 36 is disposed between the internal joint structure 32 and the sleeve structure 34 to reduce friction when the internal joint structure 32 is rotated with respect to the sleeve structure 34. Additionally, in some embodiments, bearings are disposed at other locations within the tubing hanger orientation system 30 or the overall system 10.

In some embodiments, the tubing hanger orientation system 30 includes a rotary actuator 38. The rotary actuator 38 may include a low torque actuator, as will be described in further detail below. In some embodiments, the low torque actuator is operable to provide low torque rotation within a range of 0 to about 1,000 ft-lbs. In some embodiments, low torque, as described herein, refers to a torque value of up to 1,000 ft-Ibs. For example, in some embodiments, the rotary actuator 38 provides low torque rotation of about 100 ft-lbs, 300 ft-lbs, or 500 ft-lbs. However, it should be understood that other low torque values not explicitly described, but included within the range above are also contemplated. In some embodiments, the rotary actuator 38 is operable to provide a full 360 degree range of rotation between the internal joint structure 32 and the sleeve structure 34. In some embodiments, the rotary actuator 38 further includes or is coupled to a rotation lock operable to selectively lock rotation. In some embodiments, low torque rotation is preferred over high torque alternatives because the range of rotation is relatively larger. For example, while high torque rotation devices such as a liner actuator array and a vane actuator may provide rotation within a ranges of about 50 and 100 degrees of rotation respectively, the low torque techniques contemplated herein may provide a full 360 degree rotation range.

In some embodiments, a control unit 40 is included. For example, the control unit 40 may be coupled to the rotary actuator 38 to control rotation of the tubing hanger orientation system 30. The control unit 40, for example, may include any of an orientation sensor, such as a gyroscope, one or more communications devices, and one or more valves, such as, hydraulic valves, pneumatic valves, or other forms of control valves. In some embodiments, an automated feedback loop may be provided between the gyroscope, the rotary actuator 38, and the control unit 40. For example, the control unit 40 may control the rotary actuator 38 based at least in part on a signal from a gyroscope, a rotary encoder, or another orientation sensor of the tubing hanger orientation system 30. As such, embodiments are contemplated in which the rotary actuator 38 may be automatically driven based on a signal from a gyroscope.

In some embodiments, the BOP 26 includes a BOP pin 42. The BOP pin 42 may interface with a portion of the internal joint structure 32, as shown. For example, in some embodiments, the outer sleeve structure 32 comprises a helix structure and slot structure configured to receive and react against the BOP pin 42, as will be described in further detail below. Accordingly, in some embodiments, the BOP pin 42 is interfaced with a BOP pin receiving structure on the tubing hanger orientation system 30 to provide a reaction point for rotating the tubing hanger orientation system 30 for connection to the wellhead 18. Embodiments are contemplated in which other forms of reaction points for providing rotation are used, as will be described in further detail below.

In some embodiments, the BOP 26 further includes a BOP orientation sensor 44, such as a BOP gyroscope. For example, in some embodiments, a BOP gyroscope 44 is coupled to the BOP pin 42, as shown, or to another portion of the BOP 26. Further, in some embodiments, an additional reference gyroscope 46 is included. For example, the reference gyroscope 46 may be disposed on an external template structure external to the BOP 26. In some embodiments, other forms of orientation sensors are also contemplated such as any of gyroscopes, rotary encoders, accelerometers, or magnetic sensors, as well as combinations thereof are used to determine and verify orientation of the tubing hanger orientation system 30.

In some embodiments, the tubing hanger orientation system 30 further includes a rotary encoder 48. The rotary encoder 48 may be disposed adjacent to a coupling point of the internal joint structure 32 and the sleeve structure 34. As such, the rotary encoder 48 may be operable to detect any of rotation, orientation, or angular speed of the internal joint structure 32 with respect to the sleeve structure 34. The rotary encoder may include any of a mechanical encoder, optical encoder, magnetic encoder, absolute encoder, incremental encoder, or other suitable encoder device not explicitly described herein, as well as combinations thereof. For example, in some embodiments, multiple separate encoders are included to provide verification and redundancy.

In some embodiments, the BOP 26 further includes one or more ram devices such as at least one pipe ram 50 and at least one shear ram 52, as shown. The pipe ram 50 may be operable to close an annular space between the wellbore and pipe. The shear ram 52 may be used to shear the pipe and isolate at least a portion of the well system 10. In some embodiments, the BOP 26 may include any combination of additional components not explicitly shown, such as, for example, blind rams, electrical lines, hydraulic lines, control units, and valves.

In some embodiments, the string assembly 14 includes a shear joint 54 operable to interface with the shear ram 52. For example, the shear ram 52 may interface with the shear joint 54 to isolate the well and establish barriers between hydrocarbons and the subsea environment. The string assembly 14 may further include a slick joint 56. In some embodiments, the slick joint 56 is operable to interface with the pipe rams 50. In some embodiments, a top drive is included that drives rotation of the landing string from surface level. However, the top drive may be incapable of providing fine adjustment or alignment of the tubing hanger 22. In some embodiments, the rotary actuator 38 includes a low torque actuator capable of low torque rotation of the outer sleeve structure 34 with respect to the internal joint structure 32. For example, the outer sleeve structure 34 may be rotated into a desired rotation using the rotary actuator 38 then subsequently locked to the internal joint structure 32 i.e., the inner string structure, such that vertical movement of the string assembly 14 results in rotating the string assembly 14 through interaction between the BOP pin 42 and helix structure. By contrast, the top drive may only be capable of providing rough alignment through the string assembly 14. As such, the rotary actuator 38, as well as other rotary actuators described herein provide a relatively higher accuracy alignment.

In FIG. 2, the tubing hanger orientation system 30 is shown as being positioned below the pipe rams 50 and the shear rams 52. However, further embodiments are contemplated in which the tubing hanger orientation system 30 or at least a portion of the tubing hanger orientation system 30 is positioned above the pipe rams 50 and/or the shear rams 52, as well as above any other combination of BOP rams (not shown).

Figure 3:
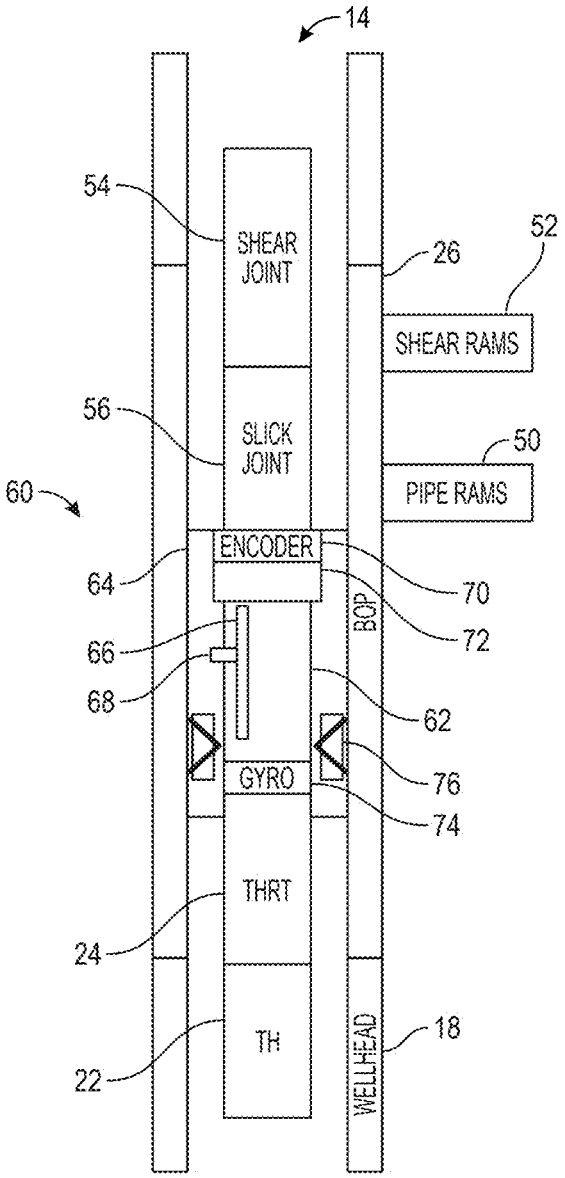
FIG. 3 illustrates an exemplary tubing hanger orientation system relating to some embodiments of the present disclosure.

FIG. 3 illustrates an exemplary tubing hanger orientation system 60 relating to some embodiments of the present disclosure. The exemplary tubing hanger orientation system 60 may be disposed within the subsea system 10 in association with at least a portion of the above-mentioned components including the wellhead 18, the tubing hanger 22, the tubing hanger running tool 24, the BOP 26, and the string assembly 14.

In some embodiments, the exemplary tubing hanger orientation system 60 includes an internal joint structure 62. The joint structure 62 may include a substantially cylindrical and longitudinal shape. For example, in some embodiments, the internal joint structure 62 includes an inner mandrel portion that is part of or coupled to the string assembly 14. However, embodiments are contemplated with alternate shapes and structural portions. In some embodiments, the internal joint structure 62 includes a sleeve structure 64, as shown. The sleeve structure 64 may be disposed around the internal joint structure 62.

In some embodiments, the sleeve structure 64 includes an alignment slot 66, such as a vertically elongated opening for receiving an alignment pin structure 68. The alignment pin structure 68 may be included as part of the internal joint structure 62 or string assembly 14. In some embodiments, the alignment pin structure 68 is hydraulically actuated. However, other suitable forms of alignment pin actuation are also contemplated such as any of hydraulic, pneumatic, electrical, magnetic, or other forms of actuation not explicitly referred to herein, as well as combinations thereof. The alignment slot 66 and alignment pin structure 68 may be used to couple the internal joint structure 62 and the sleeve structure 64, while allowing vertical adjustment as the alignment pin structure 68 slides through the alignment slot 66.

In some embodiments, the tubing hanger orientation system 60 includes a rotary encoder 70. The rotary encoder 70 may include a similar encoder as described above with respect to rotary encoder 48. Accordingly, the rotary encoder 70 may be used to detect and monitor orientation and rotation of the internal joint structure 62 with respect to the sleeve structure 64.

In some embodiments, the tubing hanger orientation system 60 includes a rotary actuator 72 operable to drive rotation of the sleeve structure 64 with respect to the internal joint structure 62 and remainder of the string assembly 14. For example, the internal joint structure 62 may remain static while the sleeve structure 64 is rotated into position by the low torque rotary actuator 72. The rotary actuator 72 may be a similar component as described above with respect to the rotary actuator 38. In some embodiments, the rotary actuator 72 includes at least one low torque motor with an output shaft coupled to the sleeve structure 64.

In some embodiments, at least one orientation sensor, such as a gyroscope 74 is included in the exemplary tubing hanger orientation system 60. For example, in some embodiments, gyroscope 74 may be included within the internal joint structure 62 to determine an orientation of the internal joint structure 62 and all components structurally coupled to the string assembly 14 including the tubing hanger 22. In some embodiments, other forms of orientation sensors are contemplated such as any of gyroscopes, encoders, accelerometers, as well as other suitable forms of orientation sensors not explicitly described herein.

In some embodiments, a brake 76 is included and coupled to the sleeve structure 64 for locking rotation of the sleeve structure 64 with respect to the BOP 26. For example, in some embodiments, the brake 76 includes one or more brake engagement portions operable to interface with at least a portion of the BOP 26, such as, for example, an internal bore of the BOP 26. In some embodiments, the brake 76 engages with any of the internal bore of the BOP 26 such as a slick section of the BOP 26, a pipe ram cavity associated with the pipe rams 50, or an annular preventer. Further, embodiments are contemplated in which multiple portions of the BOP 26 are engaged with. For example, in some embodiments, the brake 76 includes one or more piston actuators operable to extend to a portion of the BOP 26 such that the sleeve structure 64 is prevented from rotating independently from the BOP 26 while the brake is active. Accordingly, the brake 76 may be used to hold an end stop of the tubing hanger orientation assembly, such as the sleeve structure 64 in position to fine align the inner joint structure and string assembly 14. As such, the exemplary tubing hanger orientation system 60 differs from the tubing hanger orientation system 30, which utilizes the BOP pin coupling as a reaction point and instead, contemplates braking against the BOP 26 to thereby provide an end stop for fine alignment of the tubing hanger 22 through the alignment pin and alignment slot interface. Accordingly, rotational movement of the string assembly 14, for example, driven by a top drive, causes the internal joint structure 62 (i.e., inner string structure) to rotate until the alignment pin 68 aligns and extends into the alignment slot 66 in the sleeve structure 64, which has already been positioned in the correct orientation to finely align the tubing hanger 22.

Similar to as described above with respect to the tubing hanger orientation system 30, the tubing hanger orientation system 60 or at least a portion thereof may be disposed above the pipe rams 50 and/or the shear rams 52, as well as any other rams of the BOP 26 (not shown). For example, in some embodiments additional spacers are included to position the tubing hanger orientation system 60 higher in the BOP 26, such as above the pipe rams 50 and the shear rams 52.

Figure 4:
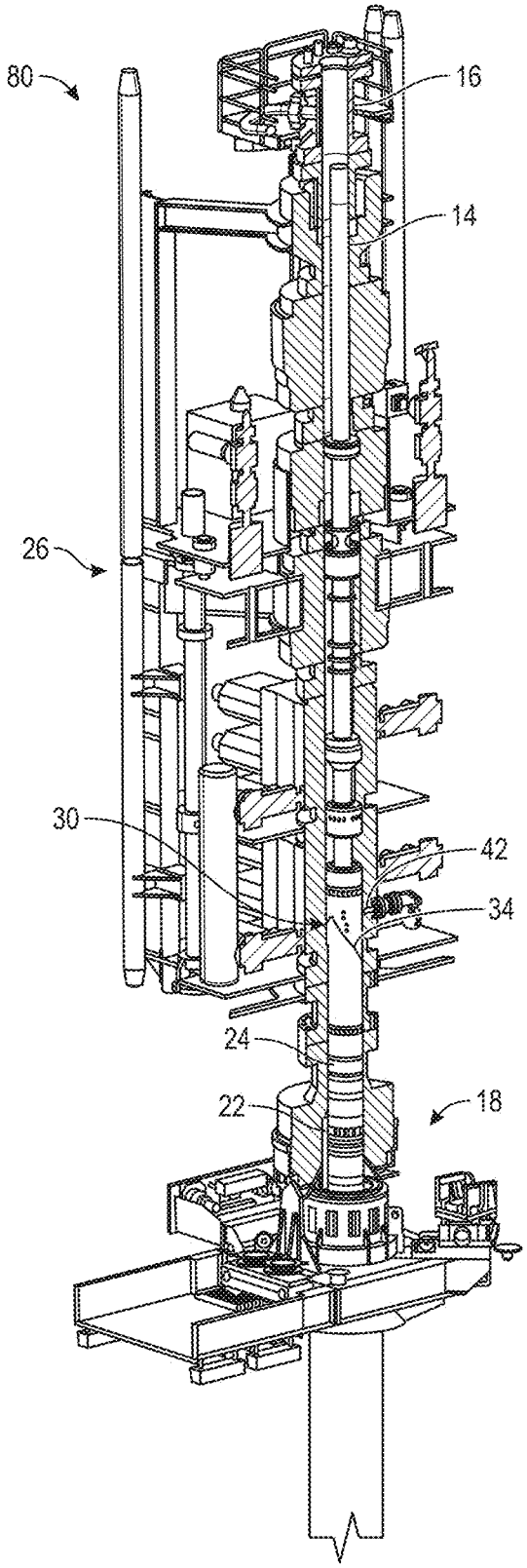
FIG. 4 illustrates a cutaway view of an exemplary subsea assembly relating to some embodiments of the present disclosure.

FIG. 4 illustrates a cutaway view of an exemplary subsea assembly 80 relating to some embodiments of the present disclosure. The subsea assembly 80 includes the string assembly 14 disposed down a bore of a riser structure 16, as shown. The subsea assembly 80 also includes the wellhead 18 disposed beneath the riser structure 16. In some embodiments, the string assembly 14 is positioned down the riser structure 16 to position the tubing hanger 22 with the tubing hanger running tool 24 and tubing hanger orientation system 30 over the wellhead 18.

The subsea assembly 80 further includes the BOP 26, as described above. The BOP 26 may include any of the above-mentioned structures including one or more pipe rams, one or more shear rams, and the BOP pin 42. Accordingly, a helix structure disposed on the outer surface of the sleeve structure 34 may be configured to receive the BOP pin 42 to thereby provide a reaction point for rotation, as mentioned above. For example, the helix structure may be used as a guide surface to guide the BOP pin 42 into a slot or receiving structure on the sleeve structure 34.

Figure 5:
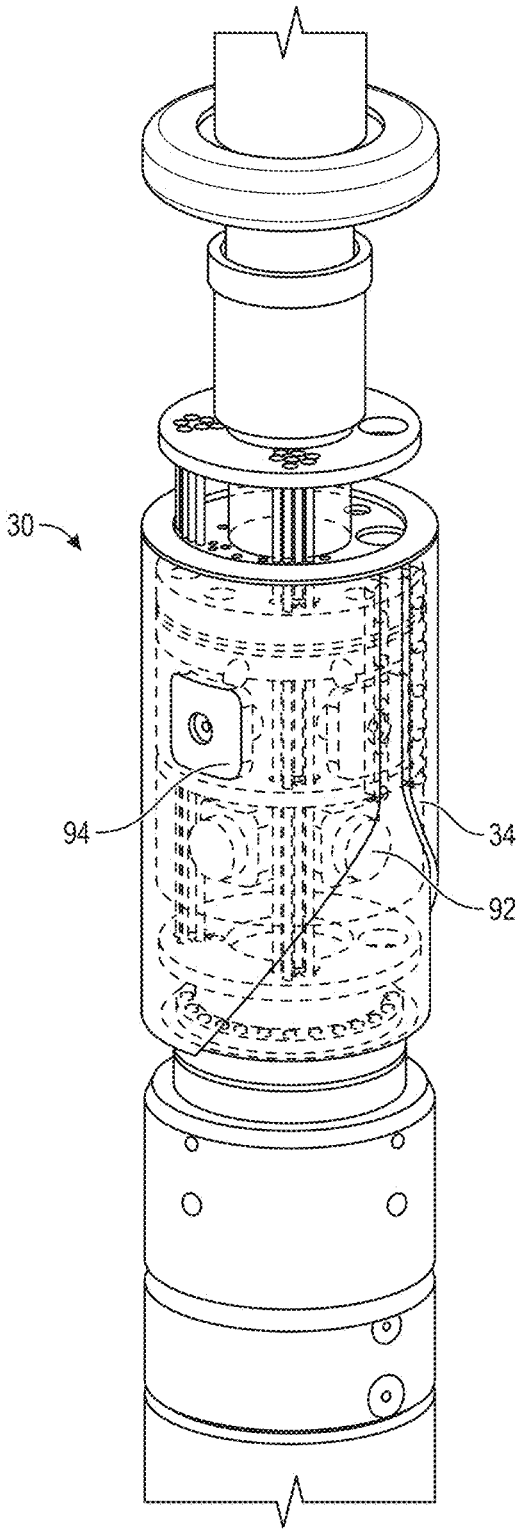
FIG. 5 illustrates an exemplary view of the tubing hanger orientation system with certain internal portions made visible relating to some embodiments of the present disclosure.

FIG. 5 illustrates an exemplary view of the tubing hanger orientation system 30 with certain internal portions made visible relating to some embodiments of the present disclosure. The external sleeve structure 34 is included with the helix structure and guide slot on the external surface of the sleeve structure 34. Additionally, internal components disposed internal to the sleeve structure 34 are made visible including an internal brake 92 and an intermediate brake 94. In some embodiments, the tubing hanger orientation system 30 includes at least one coupling component that is operable to prevent rotation of the sleeve structure 34 with respect to the remaining string assembly. For example, in some embodiments, the coupling component comprises the intermediate brake 94 operable to lock the sleeve structure 34 to the internal joint structure 32.

The internal brake 92 may be operable to hold the tubing hanger orientation system 30 in place to prevent vertical motion such that the BOP pin 42 is able to move vertically within fine alignment plates. In some embodiments, a longer fine alignment slot, such as alignment slot 66, is included. Further, after fine alignment of the BOP pin 42, the internal brake 92 allows the string assembly 14 to be stroked further down when released. Vertical, as used herein, may refer to a vertical axis running from the sea floor to the surface, an axis normal to the sea floor, or a relative longitudinal axis of the wellhead 18. For example, in some embodiments, vertical, as used herein, refers to an axis running longitudinally through the equipment of the subsea system 10.

The intermediate brake 94 may be operable to lock between the internal joint structure 32 and the sleeve structure 34. In some embodiments, the intermediate brake 94 includes one or more hydraulic actuators operable to set the sleeve structure in place. Alternatively, or additionally, in some embodiments, the intermediate brake 94 includes other forms of actuation including any of hydraulic, mechanical, electrical, magnetic actuation, or other forms of actuation not explicitly described herein, as well as combinations thereof.

Figure 6A:
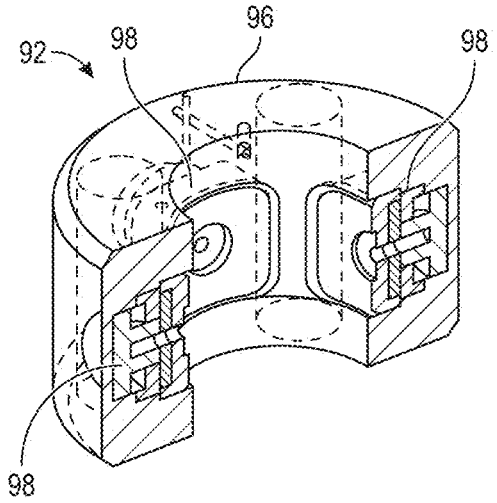
FIG. 6A illustrates an exemplary cross-sectional view of the internal brake relating to some embodiments of the present disclosure.

FIG. 6A illustrates an exemplary cross-sectional view of the internal brake 92 relating to some embodiments of the present disclosure. In some embodiments, the internal brake 92 includes an internal brake housing structure 96 operable to provide structural support and encase one or more internal components of the internal brake 92. The internal brake 92 includes one or more internal brake actuators 98, as shown. For example, in some embodiments, internal brake 92 includes a plurality of internal brake actuators 98 disposed in the internal brake housing structure 96 oriented radially and positioned around a circumference of the internal brake 92. In some embodiments, the internal brake actuators 98 are evenly spaced about the circumference of the internal brake 92. For example, in some embodiments, four internal brake actuators 98 are included. Alternatively, embodiments are contemplated in which a separate internal brake housing structure 96 is not included and the components of the internal brake 92 are disposed directly within a portion of the internal joint structure 32 or sleeve structure 34.

In some embodiments, the internal brake actuators 98 are hydraulic actuators. However, it should be understood that other forms of actuation are also contemplated, such as any of electrical, pneumatic, or magnetic. The internal brake actuators 98 may be oriented inward toward a central bore of the tubing hanger orientation system 30. Accordingly, when actuated, the internal brake actuators 98 may extend inward to interface with a portion of the string assembly 14 to prevent vertical motion of the internal joint structure 32 with respect to the remainder of the string assembly 14. In some embodiments, the internal brake actuators 98 are passively biased into a retracted position, for example, using a spring or another suitable biasing element. Accordingly, embodiments are contemplated in which the internal brake 92 is failure disengaged such that the brake 92 is automatically disengaged in the event of a control failure.

Figure 6B:
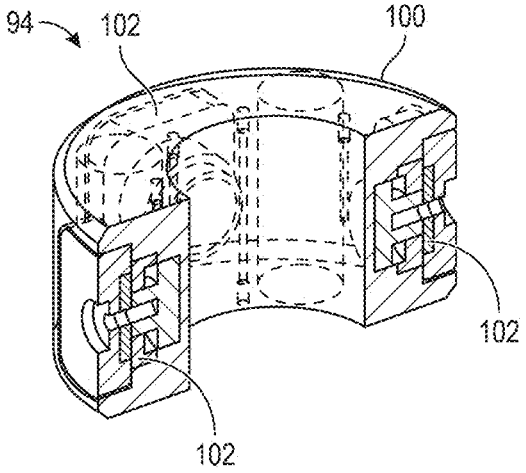
FIG. 6B illustrates an exemplary cross-sectional view of the intermediate brake relating to some embodiments of the present disclosure.

FIG. 6B illustrates an exemplary cross-sectional view of the intermediate brake 94 relating to some embodiments of the present disclosure. In some embodiments, the intermediate brake 94 includes an intermediate brake housing structure 100 operable to provide structural support and encase one or more internal components. Alternatively, embodiments are contemplated in which a separate intermediate brake housing structure 100 is not included and the components of the intermediate brake 94 are disposed directly within a portion of the internal joint structure 32 or sleeve structure 34.

Further, the intermediate brake 94 includes one or more intermediate brake actuators 102, as shown. In some embodiments, the intermediate brake 94 includes a plurality of intermediate brake actuators 102, such as four intermediate brake actuators 102 oriented radially and disposed evenly spaced about a circumference of the intermediate brake 94. Contrary to the internal brake actuators 98 described above, the intermediate brake actuators 102 are extended outwardly when actuated. For example, in some embodiments, the intermediate brake 94 is included on or coupled to the internal joint structure 32 and the intermediate brake actuators 102 are configured to extend outward to interface with an internal surface of the sleeve structure 34 such that position of the internal joint structure 32 is locked with respect to the sleeve structure 34.

Figure 7:
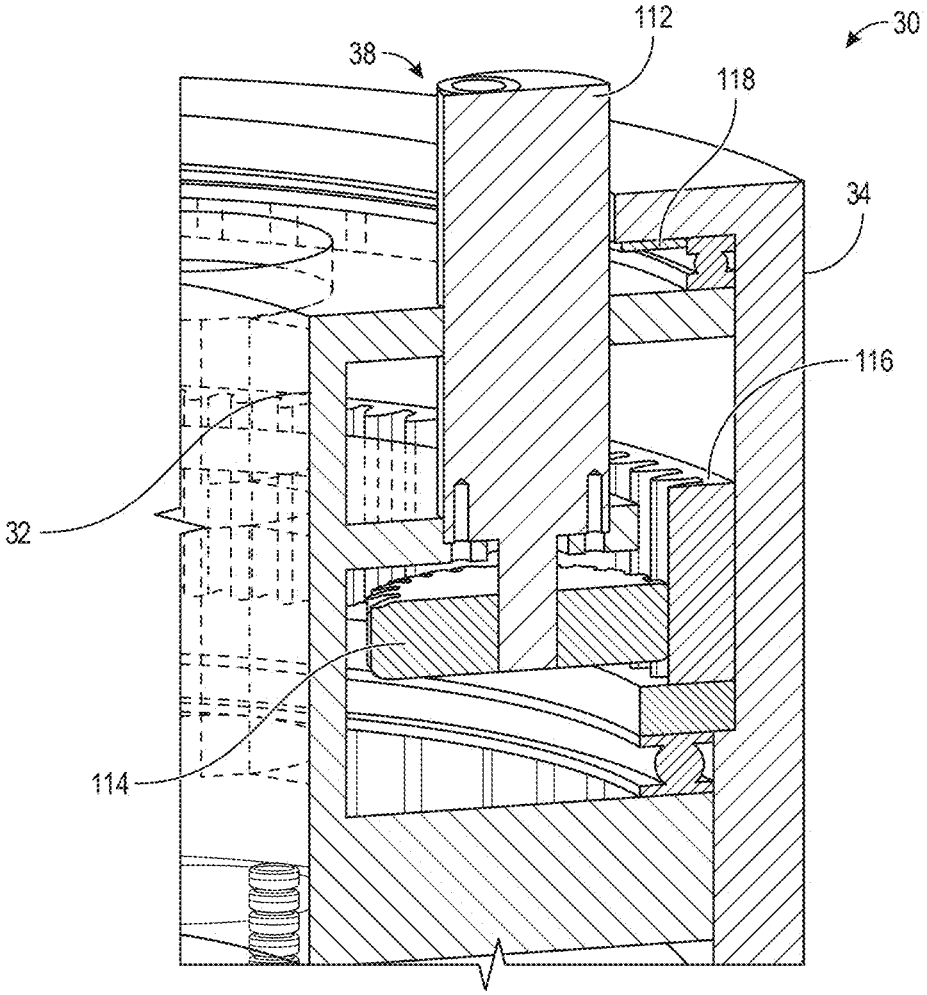
FIG. 7 illustrates a cross-sectional view of the tubing hanger orientation system including an exemplary assembly of the rotary actuator relating to some embodiments of the present disclosure.

FIG. 7 illustrates a cross-sectional view of the tubing hanger orientation system 30 including an exemplary assembly of the rotary actuator 38 relating to some embodiments of the present disclosure. In some embodiments, the rotary actuator 38 includes a motor 112, as shown. The motor 112 includes a motor body and an output shaft. In some embodiments, the motor 112 is a hydraulic motor; however, other suitable forms of motor actuation are also contemplated such as electric actuation and pneumatic actuation, as well as other suitable forms of actuation not explicitly described herein.

In some embodiments, an output shaft of the motor 112 is coupled to a gear 114, as shown. Accordingly, the motor 112 may directly drive rotation of gear 114. The gear 114 may be coupled to an internal gear 116 such that the gear 114 drives rotation of the internal gear 116. The internal gear 116 may be disposed on an internal surface of the sleeve structure 34 such that the motor 112 drives rotation of the sleeve structure 34 through the gear coupling. In some embodiments, the internal gear 116 is an internal ring gear with a plurality of gear teeth disposed along an internal surface of a ring body structure. In some embodiments, a gear ratio between the internal gear 116 and the gear 114 is greater than 1.

In some embodiments, the tubing hanger orientation system 30 includes a plurality of motors 112. For example, embodiments are contemplated in which four motors 112 are included evenly spaced about a circumference of the tubing hanger orientation system 30. Each of the four motors 112 may be coupled to a respective gear 114 that interfaces with the internal gear teeth of the internal gear 116 and the motors 112 may be actuated simultaneously to rotate the internal gear 116. Rotation of the internal gear 116 causes rotation of the sleeve structure 34 with respect to the internal joint structure 32. Alternatively, or additionally, it should be understood that other forms of rotational coupling besides the internal gear coupling are contemplated. For example, other forms of gear coupling as well as other forms of driving rotation of the sleeve structure, not explicitly described herein are also contemplated.

In some embodiments, the tubing hanger orientation system 30 further includes a rotary encoder 118 disposed, for example, on the sleeve structure 34, to detect rotation of the sleeve structure 34 with respect to the internal joint structure 32. In some embodiments, the rotary encoder 118 is operable to account for error between the BOP pin 42 or alignment pin, the sleeve structure 34, and the tubing hanger 22. For example, the rotary encoder 118 may be used in addition to a gyroscope reading to determine the orientation of the tubing hanger and related components. In some embodiments, multiple forms of orientation detection are used to reduce error and provide redundancy.

In some embodiments, a slip joint structure 120 is included. For example, the slip joint structure 120 may be disposed on the string assembly 14, such as, above the tubing hanger running tool 24 and/or on the internal joint structure 62. In some embodiments, the rotary encoder 70 may be disposed on the slip joint structure 120. The slip joint structure 120 may be used to provide a rotational joint coupling between the sleeve structure 64 and the internal joint structure 62. Further, in some embodiments, the slip joint structure 120 also provides a hydraulic coupling. For example, the slip joint structure 120 may include a hydraulic slip ring to transmit hydraulic signals and power to the sleeve structure 64 while allowing independent rotation between the structures.

Figure 8:
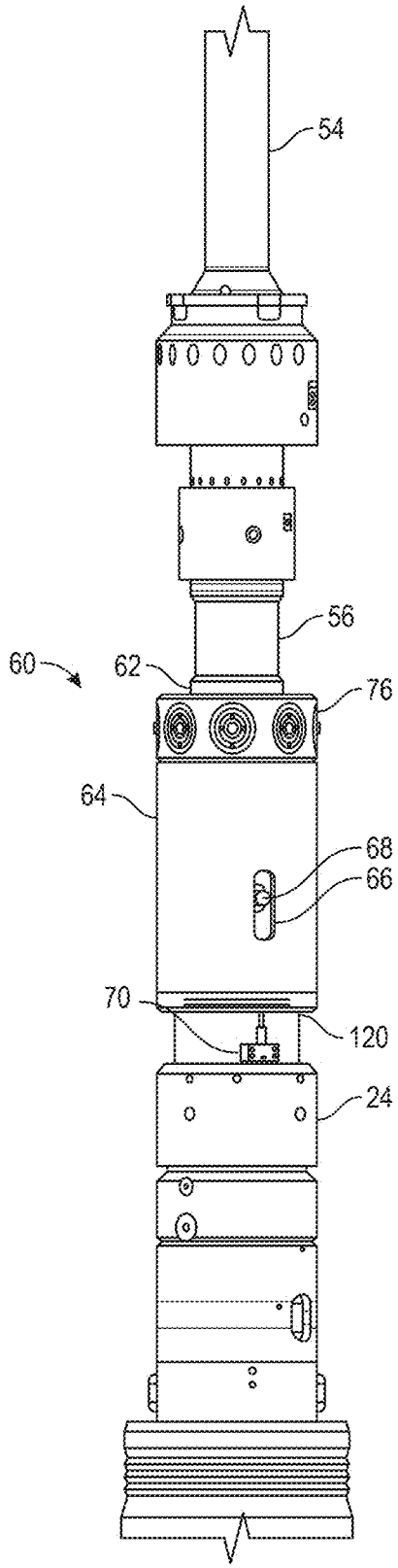
FIG. 8 illustrates an exemplary view of the tubing hanger orientation system 60 relating to some embodiments of the present disclosure.

FIG. 8 illustrates an exemplary view of the tubing hanger orientation system 60 relating to some embodiments of the present disclosure. The exemplary tubing hanger orientation system 60 is integrated into the subsea system 10 and coupled to the tubing hanger running tool 24, as shown, with the shear joint 54 and slick joint 56 of the string assembly 14 disposed above the tubing hanger orientation system 60.

The tubing hanger orientation system 60 includes the internal joint structure 62 with the sleeve structure 64 disposed around the internal joint structure 62, as shown. The sleeve structure 64 includes the alignment slot 66 providing a vertically elongated opening for the alignment pin 68 to extend through. The alignment pin 68 may be disposed on the internal joint structure 62 and may be selectively extended to engage the alignment slot 66. As mentioned above, when the alignment pin 68 is extended, the alignment slot and pin coupling prevents rotation of the internal joint structure 62 with respect to the sleeve structure 64 but allows vertical adjustment.

In some embodiments, the tubing hanger orientation system 60 further includes the brake 76, as shown. The brake 76 may be disposed at an upper portion of the sleeve structure 64. Additionally, or alternatively, embodiments are contemplated in which the brake 76 is disposed elsewhere on the sleeve structure 64 or the tubing hanger orientation system 60 in general. For example, the brake 76 may be disposed at a lower portion or middle portion of the sleeve structure 64.

The brake 76 may be operable to interface with at least a portion of the BOP 26 to provide a fixing point of the orientation sleeve (i.e., the outer sleeve structure 64) such that alignment pin 68 interaction with the outer sleeve structure 64 acts as an end stop, as described above. For example, in some embodiments, the brake 76 is vertically aligned, for example, to avoid a pipe ram cavity of the BOP 26 such that the brake 76, when actuated, engages an internal bore of the BOP 26 to prevent rotation of the sleeve structure 64 with respect to the BOP 26. Alternatively, or in addition, embodiments are contemplated in which other portions of the BOP 26 are engaged by the brake 76. For example, in some embodiments, the brake 76 is operable to interface with at least a portion of the BOP 26 such as any of a pipe ram cavity, an annular preventer, or an internal bore of the BOP 26. Further still, embodiments are contemplated in which multiple braking components are used to engage multiple portions of the BOP 26.

Figure 9B:
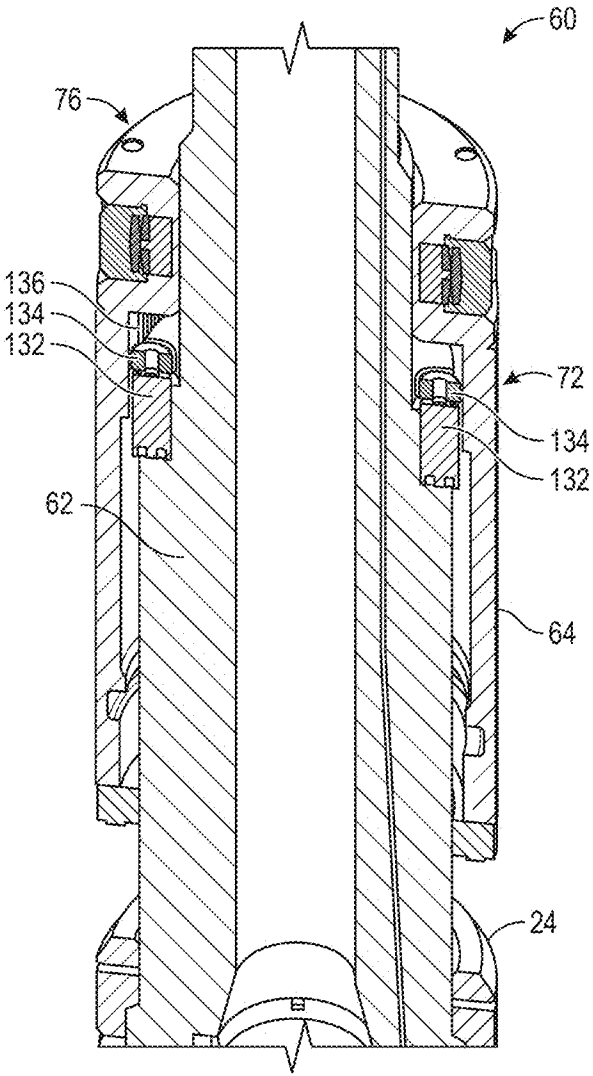
FIG. 9B illustrates another cross-sectional view of the tubing hanger orientation system revealing internal components of the tubing hanger orientation system relating to some embodiments of the present disclosure.
Figure 9A:
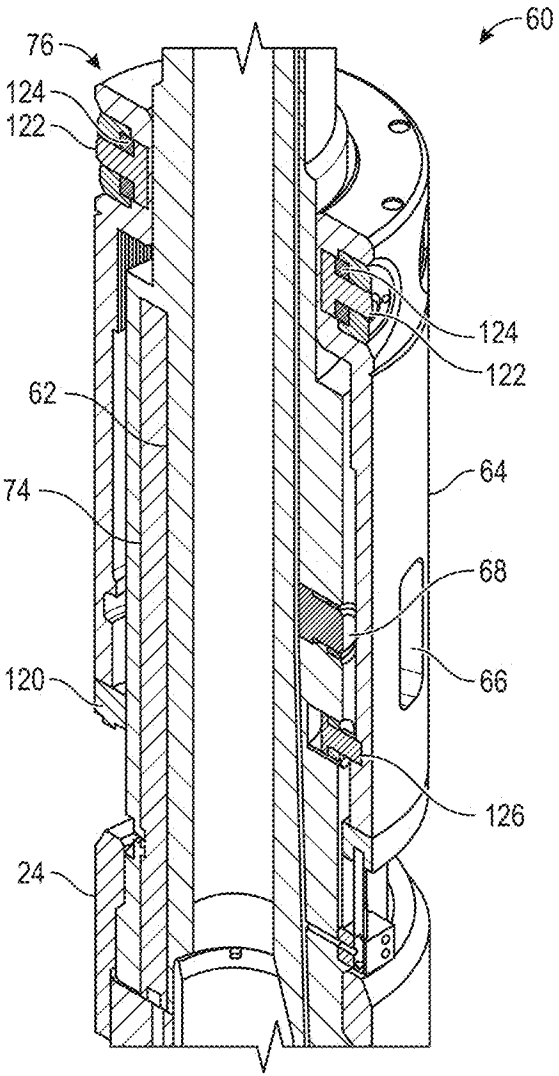
FIG. 9A illustrates a cross-sectional view of the tubing hanger orientation system revealing internal components of the tubing hanger orientation system relating to some embodiments of the present disclosure.

FIG. 9A illustrates a cross-sectional view of the tubing hanger orientation system 60 revealing internal components of the tubing hanger orientation system 60 relating to some embodiments of the present disclosure. The tubing hanger orientation system 60 may include any combination of the above mentioned structures and components including the internal joint structure 62 coupled to the tubing hanger running tool 24, as shown, and the sleeve structure 64 with the alignment slot 66 operable to receive the alignment pin structure 68 of the internal joint structure 62, when extended.

In some embodiments, the tubing hanger orientation system 60 includes the brake 76, as shown. The brake 76 may be coupled to the outer sleeve structure 64 and disposed around the internal joint structure 62. The brake 76 may include one or more brake actuators 122. In some embodiments, the brake actuators 122 are hydraulically actuated. For example, each brake actuator 122 may include a hydraulic piston operable to be extended in response to hydraulic actuation from one or more hydraulic lines. Alternatively, or additionally, in some embodiments, the brake actuators 122 are actuated using another suitable actuation technique such as any of electrical, pneumatic, or combinations thereof.

In some embodiments, the brake actuators 122 may be passively biased into a retracted position. For example, a respective biasing spring 124 may be included for each brake actuator 122 to bias a piston of the brake actuator 122 into the retracted position when the brake 76 is not engaged. Further, in some embodiments, because the brake actuators 122 are passively retracted, the brake 76 may be automatically disengaged in the case of a control failure. As such, if active control is lost, the brake actuators 122 are automatically retracted, for example, using the biasing springs 124, and the brake 76 is disengaged from braking against the BOP 26 or any other portion of the subsea well system 10. In some embodiments, the brake 76 includes a weak link or load limiter operable to free the brake system in the event of heave compensation lockup and/or brake lock. For example, embodiments are contemplated in which the brake 76 includes a load-dependent force regulator or a proportional load limiting valve operable to prevent brake lockup.

In some embodiments, the brake actuators 122, when engaged are operable to extend to a portion of the BOP 26. For example, the brake actuators 122 may be extended to contact an internal surface of the BOP bore. Alternatively, embodiments are contemplated in which the brake actuators 122 are extended into a pipe ram cavity of the BOP 26 to prevent rotation of the sleeve structure 64 with respect to the BOP 26. Further, in some embodiments, the brake actuators 122 may interface with an annular preventer to prevent rotation of the sleeve structure 64. Accordingly, the brake 76, when engaged, holds the sleeve structure 64 in place. The rotary actuator 72 may be used to position the sleeve structure to a desired heading prior to rotating the inner string using the top drive to align the alignment pin structure 68 into the alignment slot 66.

In some embodiments, the brake actuators 122 are hydraulically actuated and hydraulic power may be transmitted from the string assembly 14 to the sleeve structure 64 using the hydraulic slip ring, as described above. The tubing hanger orientation system 60 may further include an additional alignment pin 126 disposed on the internal joint structure 62. The additional alignment pin 126 may be operable to extend into a cavity within the inner surface of the sleeve structure 64 to prevent vertical motion between the internal joint structure 62 and the sleeve structure 64.

In some embodiments, the gyroscope 74 is disposed within a portion of the internal joint structure 62, as shown. For example, the gyroscope 74 may include a linear gyroscope device that extends at least a portion of the length of the internal joint structure 62. Alternatively, or additionally, in some embodiments, other suitable mounting locations of the gyroscope 74 are contemplated. Further, in some embodiments, multiple gyroscopes may be used, as well as other forms of orientation sensors. Further still, in some embodiments, other forms of orientation sensors are used such as any of gyroscopes, rotary encoders, accelerometers, as well as other suitable orientation sensing devices, and combinations thereof.

FIG. 9B illustrates another cross-sectional view of the tubing hanger orientation system 60 revealing internal components of the tubing hanger orientation system 60 relating to some embodiments of the present disclosure. The cross-sectional view of FIG. 9B is distinct from the cross-sectional view of FIG. 9A and illustrates components of the rotary actuator 72.

In some embodiments, the rotary actuator 72 comprises a similar structure as described above with respect to the rotary actuator 38 as shown in FIG. 7. In some embodiments, the rotary actuator 72 includes one or more motors 132. The motors 132 may be any of hydraulically actuated motors, electrically actuated motors, pneumatically actuated motors, as well as other suitable forms of motors not explicitly described herein, and combinations thereof. In some embodiments, the rotary actuator 72 further includes a gear 134 coupled to the output shaft of each respective motor 132. The gears 134 are coupled to an internal gear 136 mounted on an internal surface of the sleeve structure 64.

In some embodiments, the rotary actuator 72 is operable to provide a full 360 degree range of rotation to properly orient the tubing hanger 22. For example, the one or more motors 132 may impart a low torque rotation force between the sleeve structure 64 and the internal joint structure 62 to rotate the sleeve structure 64 with respect to the internal joint structure 62. In some embodiments, the motors 132 drive rotation of the sleeve structure 64 through the gear coupling to a selected orientation or orientation within the full 360 degree range of the rotary actuator 72.

Figure 10:
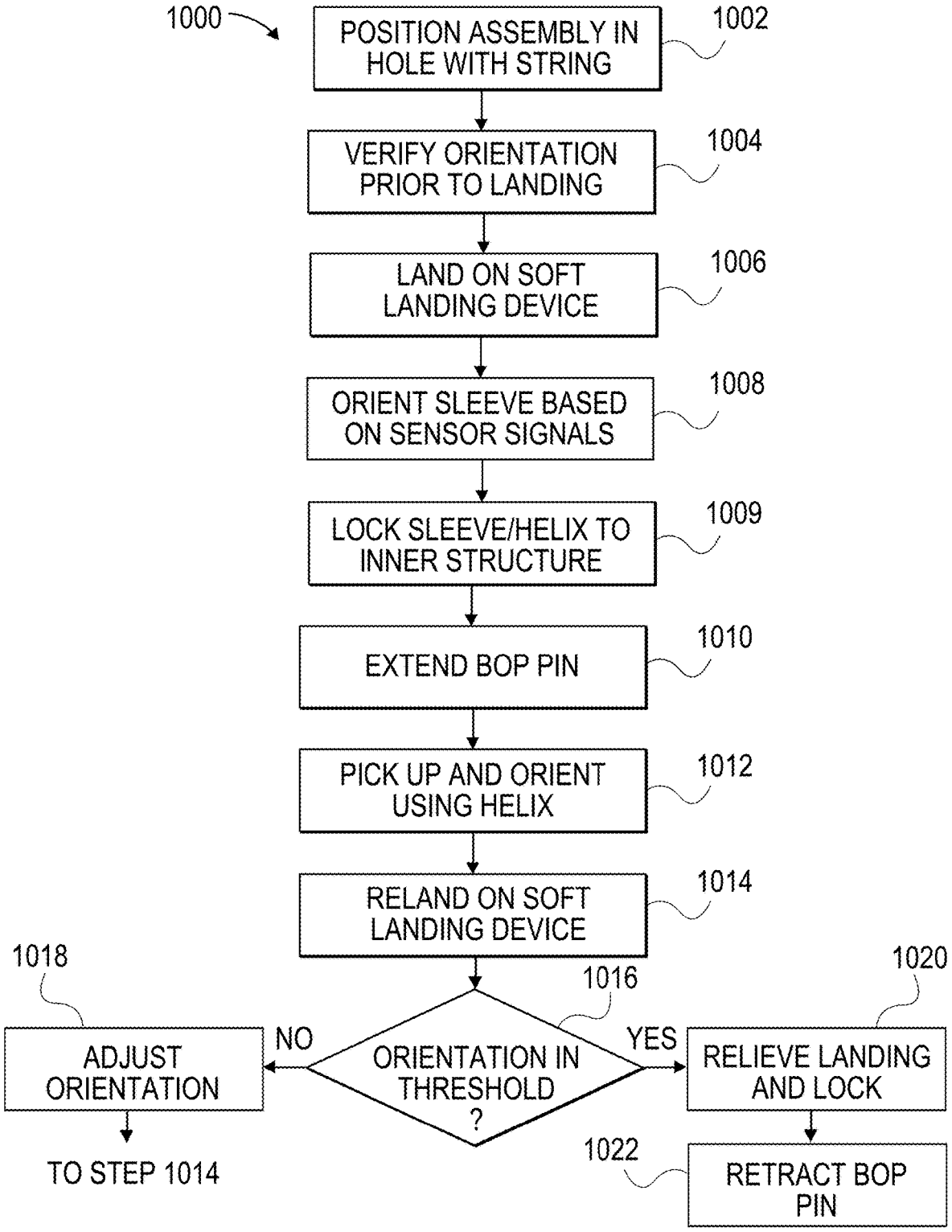
FIG. 10 illustrates an exemplary method for installing a tubing hanger assembly relating to some embodiments of the present disclosure.

FIG. 10 illustrates an exemplary method 1000 for installing a tubing hanger assembly relating to some embodiments of the present disclosure. The method 1000 may be performed using one or more components of the subsea system 10, the tubing hanger orientation system 30, the tubing hanger orientation system 60, or a control system. For example, in some embodiments, at least a portion of the steps of method 1000 are performed by executing computer-executable instructions stored on one or more non-transitory computer-readable media using at least one processor of a control component of the subsea system 10.

At step 1002, the tubing hanger orientation assembly is positioned in a hole of the subsea system 10 using a string assembly, such as a landing string. For example, the tubing hanger orientation assembly may be lowered from surface level using a string assembly from the surface platform 12.

At step 1004, an orientation of the tubing hanger orientation assembly is verified prior to a landing operation. For example, a rotational orientation of the tubing hanger orientation assembly may be determined using at least one gyroscopic sensor, such as any of the gyroscopes described herein. In some embodiments, one or more external gyroscopic sensors are also used to verify the orientation. For example, a template gyroscope disposed on a template structure or a permanent guidebase may be used as a reference point.

At step 1006, the tubing hanger orientation assembly is lowered to land on a soft landing device. For example, a soft landing piston may be disposed between a lower end of the tubing hanger 22 and the wellhead 18. The soft landing piston may be configured to receive the end of the tubing hanger 22 and provide a soft landing point to couple the tubing hanger 22 and wellhead connection. The soft landing piston also prevents engagement with a gasket prior to aligning the tubing hanger in the correct position.

At step 1008, sleeve structure of the tubing hanger orientation assembly is oriented based on one or more sensor signals. For example, in some embodiments, an orientation of the sleeve structure is adjusted using one or more rotary actuators of the tubing hanger orientation system, such as the rotary actuator 38. The orientation may be adjusted based on one or more signals from orientation sensors disposed on the assembly. For example, in some embodiments, the sleeve structure and/or helix structure is oriented by driving rotation based on any one of or combination of signals from the control unit 40, the rotary encoder 48, or the gyroscope 74. In some embodiments, a combination of orientation signals including at least one orientation signal from a gyroscope and at least one orientation signal from a rotary encoder are used to determine an orientation of the tubing hanger 22 with respect to the BOP 26 or other components of the subsea well system 10. Further, in some embodiments, one or more reference gyroscopes disposed on other structures such as a template structure or permanent guidebase are used as a reference point for the tubing hanger orientation.

At step 1009, the outer structure (i.e., sleeve structure 34, sleeve structure 64, or helix structure disposed thereon) is locked to the inner structure (i.e., the internal joint structure 32, internal joint structure 62, or other string-coupled structure). For example, the sleeve structure may be locked to the internal structure via a coupling component, such as the intermediate brake 94 to prevent the sleeve structure from rotating with respect to the internal joint structure and remaining string assembly 14.

In some embodiments, the sleeve structure and helix is fine aligned using a low torque rotation actuator such as, the rotary actuator 38. For example, in some embodiments, the rotary actuator provides fine alignment to within 1.5 degrees from a target rotational orientation. In some embodiments, the rotary actuator provides a fine adjustment or fine alignment to the rotational orientation of the sleeve structure to prime an orientation of the overall tubing hanger orientation assembly via subsequent vertical adjustment, for example, within a rotational orientation range of 2 degrees, 1.95 degrees, 1.5 degrees, 1 degree, 0.8 degrees, 0.5 degrees, 0.2 degrees, 0.1 degrees, 0.05 degrees, 0.02 degrees, and 0.01 degrees in either direction from a final desired rotation. In some embodiments, the accuracy of the fine alignment is up to less than 1 degree from a desired heading for the tubing hanger.

At step 1010, the BOP pin 42 of the BOP 26 is extended into a BOP pin receiving portion of the tubing hanger orientation assembly. As described above, the BOP pin 42 may be received into a helix structure and/or slot on the sleeve structure. Accordingly, the coupling with the BOP pin 42 may be used as a reaction point to rotate the tubing hanger orientation assembly through interaction with the properly oriented helix structure, which has been locked to the inner string structure such that the helix interaction rotates the entire string when the string is vertically adjusted.

At step 1012, the tubing hanger orientation assembly is picked up and oriented using the helix structure of the tubing hanger orientation assembly. In some embodiments, the tubing hanger orientation assembly is temporarily lifted away from the soft landing device. In some embodiments, the tubing hanger orientation assembly is oriented within 1 degree of a desired rotational orientation responsive to interaction of the BOP pin 42 with the helix structure.

At step 1014, after orienting the tubing hanger orientation assembly, the tubing hanger orientation assembly is landed again onto the soft landing device. For example, an end of the tubing hanger 22 is landed back onto the soft landing piston. In some embodiments, the rotational alignment of the tubing hanger orientation assembly is held while stroking down to land on the soft landing device.

At step 1016, it is determined whether an orientation of the tubing hanger orientation assembly is within a predetermined threshold orientation range, for example, using at least one gyroscopic sensor of the tubing hanger orientation assembly and/or at least one rotary encoder. In some embodiments, the gyroscopic sensor is used to verify a rotational orientation after an initial alignment with the rotary actuator.

If the orientation is determined not to be within a predetermined orientation threshold by the orientation confirmation at step 1016, the orientation is further adjusted at step 1018. In some embodiments, the tubing hanger orientation assembly may be lifted prior to and during the further adjustment. The adjustment may be performed based at least in part on the orientation sensor signals such as a signal from the gyroscope and a signal from the rotary encoder, as well as signals from other forms of orientation sensors not explicitly described herein. For example, a feedback loop may be provided between the at least one gyroscope and the control system of the rotary actuator to automatically adjust the orientation based on the gyroscope sensor until a correct installation orientation is achieved. Further, in some embodiments, the rotary encoder may be used as part of the feedback control loop or to reduce error in the orientation measurement.

At step 1020, the soft landing device is relieved, and the tubing hanger is locked against the wellhead 18. In some embodiments, the soft landing device, such as a soft landing piston is relieved by bleeding off a pressure from the soft landing piston. For example, the soft landing device may be relieved until the end of the tubing hanger 22 contacts the wellhead 18 for coupling to the well head to complete installation of the tubing hanger 22.

At step 1022, the BOP pin 42 is retracted from the BOP interface point of the tubing hanger orientation assembly to disengage the tubing hanger from the BOP. The BOP pin 42 may be extended throughout the installation process until after the final alignment is confirmed. After retraction of the BOP pin 42 the landing string may be lifted and removed from the subsea system 10.

Figure 11:
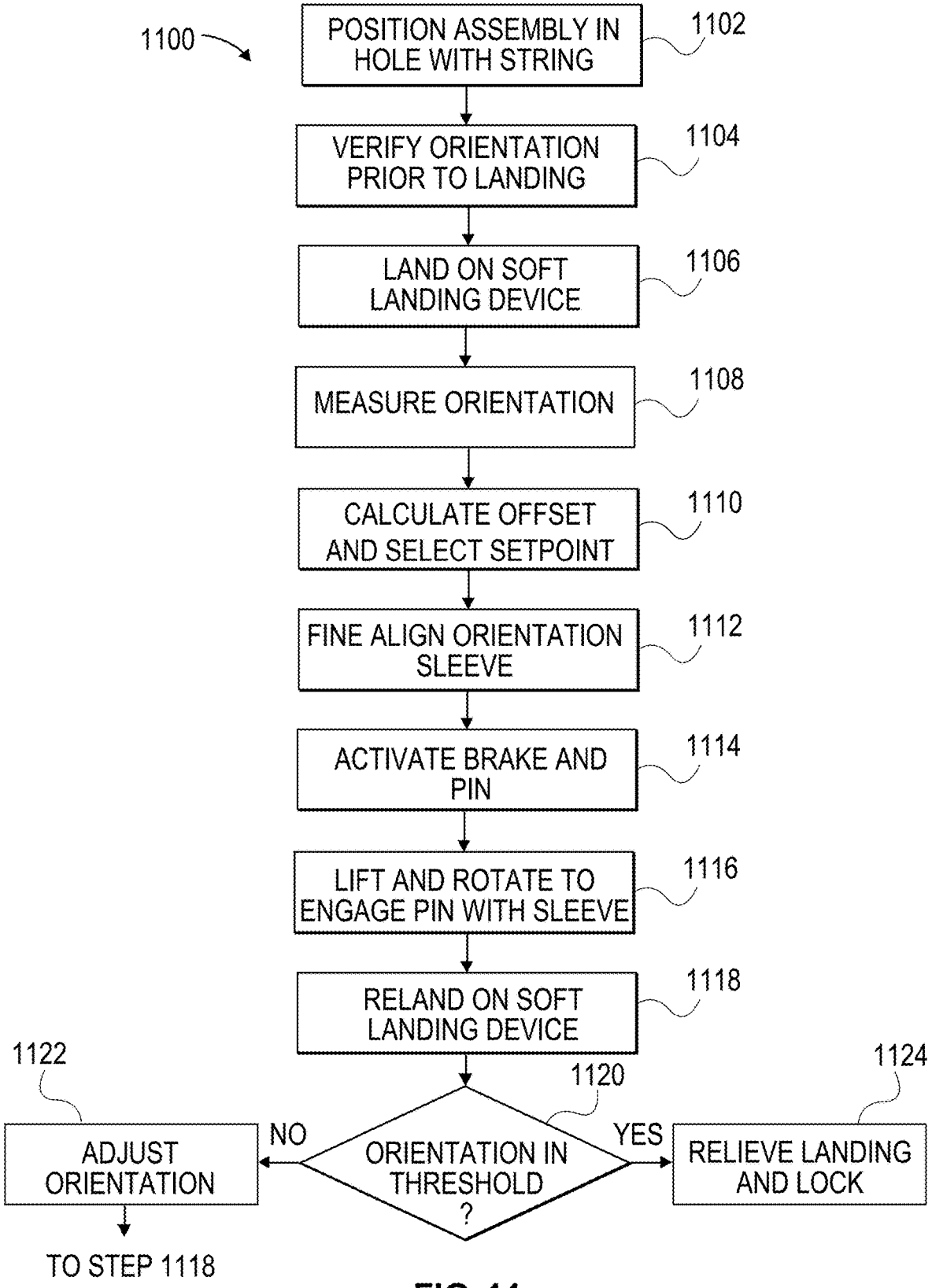
FIG. 11 illustrates an exemplary method for installing a tubing hanger assembly relating to some embodiments of the present disclosure.

FIG. 11 illustrates an exemplary method 1100 for installing a tubing hanger assembly relating to some embodiments of the present disclosure. Similar to the method 1000, the method 1100 may be performed using one or more components of the subsea system 10, the tubing hanger orientation system 30, the tubing hanger orientation system 60, or an associated control system. For example, in some embodiments, at least a portion of the steps of method 1100 are performed by executing computer-executable instructions stored on one or more non-transitory computer-readable media using at least one processor of a control component of the subsea system 10.

At step 1102, the tubing hanger orientation assembly is positioned in a hole of the subsea system 10 using a string assembly, such as a landing string. For example, the tubing hanger orientation assembly may be lowered from surface level using a string assembly from the surface platform 12.

At step 1104, an orientation of the tubing hanger orientation assembly is verified prior to a landing operation. For example, a rotational orientation of the tubing hanger orientation assembly may be determined using at least one gyroscopic sensor, such as any of the gyroscopes described herein. In some embodiments, one or more external gyroscopic sensors are also used to verify the orientation. For example, a template gyroscope disposed on a template structure may be used as a reference point.

At step 1106, the tubing hanger orientation assembly is lowered to land on a soft landing device. For example, a soft landing piston may be disposed between a lower end of the tubing hanger 22 and the wellhead 18. The soft landing piston may be configured to receive the end of the tubing hanger 22 and provide a soft landing point to couple the tubing hanger 22 and wellhead connection.

At step 1108, an orientation of the tubing hanger orientation assembly is measured, for example, using at least one of the orientation sensors described herein, such as, a sensor of control unit 40, rotary encoder 48, rotary encoder 70, or gyroscope 74. In some embodiments, an initial rotational orientation is measured to determine a rotational adjustment value for subsequent rotational adjustment of the tubing hanger orientation assembly.

At step 1110, an offset of the tubing hanger orientation assembly is calculated and a setpoint is selected. In some embodiments, the offset is determined based on a difference between the measured orientation of step 1108 and a target orientation or desired heading for the tubing hanger orientation assembly. The setpoint may be selected based on the determined offset and is indicative of the final target orientation. For example, the setpoint may include a requested adjustment action operable to achieve the target orientation or place the tubing hanger orientation assembly within a target range of the target orientation.

At step 1112, the outer sleeve structure 64 of the tubing hanger orientation assembly including the alignment slot 66, as described above, is rotated using the rotary actuator such as the low torque rotary actuator described herein. For example, the outer sleeve may be rotated using a plurality of motors coupled to an internal gear of the sleeve structure. In some embodiments, the rotary actuator provides a fine adjustment or fine alignment to the rotational orientation of the outer sleeve structure, for example, within a rotational orientation range of 2 degrees, 1.95 degrees, 1.5 degrees, 1 degree, 0.8 degrees, 0.5 degrees, 0.2 degrees, 0.1 degrees, 0.05 degrees, 0.02 degrees, and 0.01 degrees in either direction from a final desired rotation. In some embodiments, the accuracy of the fine alignment is up to less than 1 degree from a desired heading for the tubing hanger.

At step 1114, at least one brake of the tubing hanger orientation assembly is activated to lock the correctly oriented outer sleeve structure 64 into place in the BOP 26. For example, in some embodiments, the brake 76 is activated such that the brake actuators 122 extend into a portion of the BOP 26 to prevent rotation of the sleeve structure 64 with respect to the BOP 26. Further, at least one pin of the tubing hanger orientation assembly may be activated. For example, a hydraulically actuated pin may be activated and extend into an alignment slot of the tubing hanger orientation assembly.

At step 1116, the inner string portion (i.e., the internal joint structure 62) of the tubing hanger orientation assembly is lifted and rotated to engage the pin. For example, a top drive may be used to lift and rotate the tubing hanger orientation assembly such that the hydraulically actuated pin (i.e., pin structure 68), as mentioned above, extends into the alignment slot 66 in the outer sleeve structure 64. Alternatively, or additionally, embodiments are contemplated in which the tubing hanger orientation assembly is rotated without being lifted.

At step 1118, the tubing hanger orientation assembly is landed again onto the soft landing device. For example, an end of the tubing hanger 22 is landed back onto the soft landing piston.

At step 1120, it is determined whether an orientation of the tubing hanger orientation assembly is within a predetermined threshold orientation range, for example, using at least one gyroscopic sensor of the tubing hanger orientation assembly and/or at least one rotary encoder. In some embodiments, the gyroscopic sensor is used to verify a rotational orientation after an initial alignment with the rotary actuator.

If the orientation is determined not to be within a predetermined orientation threshold by the orientation confirmation at step 1120, the orientation is further adjusted at step 1122. In some embodiments, the tubing hanger orientation assembly may be lifted prior to and during the further adjustment. The adjustment may be performed based at least in part on the orientation sensor signals such as a signal from the gyroscope and a signal from the rotary encoder, as well as signals from other forms of orientation sensors not explicitly described herein. For example, a feedback loop may be provided between the at least one gyroscope and the control system of the rotary actuator to automatically adjust the orientation based on the gyroscope sensor until a correct installation orientation is achieved. Further, in some embodiments, the rotary encoder may be used as part of the feedback control loop or to reduce error in the orientation measurement.

If the orientation is determined to be within the predetermined orientation threshold, the method 1100 moves to step 1124. At step 1124, the soft landing device is relieved, and the tubing hanger 22 is locked against the wellhead 18. In some embodiments, the soft landing device, such as a soft landing piston is relieved by bleeding off a pressure from the soft landing piston. For example, the soft landing device may be relieved until the end of the tubing hanger 22 contacts the wellhead 18 for coupling to the wellhead 18 to complete installation of the tubing hanger 22.

The following embodiments represent exemplary embodiments of concepts contemplated herein. Any one of the following embodiments may be combined in a multiple dependent manner to depend from one or more other clauses. Further, any combination of dependent embodiments (e.g., clauses that explicitly depend from a previous clause) may be combined while staying within the scope of aspects contemplated herein. The following clauses are exemplary in nature and are not limiting.

Clause 1. A tubing hanger orientation assembly for coupling a tubing hanger assembly to a wellhead, the tubing hanger orientation assembly comprising: an internal joint structure operable to be placed within an internal bore of a blowout preventer (BOP) associated with the wellhead; a sleeve structure disposed around the internal joint structure; a rotary actuator that interfaces with the sleeve structure, the rotary actuator operable to drive rotation of the sleeve structure with respect to the internal joint structure; a coupling component operable to lock the sleeve structure to the internal joint structure such that rotation of the sleeve structure with respect to the internal joint structure is prevented; a reaction point that interfaces with the BOP for rotation of the internal joint structure with respect to the BOP; and at least one orientation sensor operable to measure a rotational orientation of the tubing hanger assembly.

Clause 2. The tubing hanger orientation assembly of clause 1, wherein the sleeve structure comprises an internal gear element with a plurality of gear teeth disposed along an internal surface of the sleeve structure, and wherein the rotary actuator comprises a hydraulic motor.

Clause 3. The tubing hanger orientation assembly of any of clauses 1-2, further comprising: a gear coupled to an output shaft of the hydraulic motor, wherein the gear engages with at least a portion of the plurality of gear teeth of the internal gear element such that the sleeve structure is rotated responsive to actuation of the hydraulic motor.

Clause 4. The tubing hanger orientation assembly of any of clauses 1-3, further comprising a vertically elongated keyway disposed on the tubing hanger orientation system, the vertically elongated keyway operable to maintain a heading of the tubing hanger during vertical stroking of the tubing hanger orientation assembly.

Clause 5. The tubing hanger orientation assembly of any of clauses 1-4, further comprising: a rotary encoder disposed on the sleeve structure and operable to detect rotation of the sleeve structure with respect to the internal joint structure.

Clause 6. The tubing hanger orientation assembly of any of clauses 1-5, wherein the at least one orientation sensor comprises a gyroscopic sensor.

Clause 7. The tubing hanger orientation assembly of any of clauses 1-6, wherein rotary actuator is driven based at least in part on a signal from the at least one orientation sensor and the rotary encoder.

Clause 8. A tubing hanger orientation assembly for coupling a tubing hanger assembly to a wellhead, the tubing hanger orientation assembly comprising: an internal joint structure operable to be placed within an internal bore of a blowout preventer (BOP) associated with the wellhead; a sleeve structure disposed around the internal joint structure; a rotary actuator that interfaces with the sleeve structure, the rotary actuator operable to drive rotation of the sleeve structure with respect to the internal joint structure; a coupling component operable to lock the sleeve structure to the internal joint structure such that rotation of the sleeve structure with respect to the internal joint structure is prevented; a brake disposed on the sleeve structure, the brake operable to interface with a portion of the BOP; and at least one orientation sensor operable to measure a rotational orientation of the tubing hanger assembly.

Clause 9. The tubing hanger orientation assembly of clause 8, wherein the rotary actuator comprises a plurality of motors disposed within a portion of the internal joint structure.

Clause 10. The tubing hanger orientation assembly of any of clauses 8-9, further comprising: an internal gear element including a plurality of gear teeth disposed along an internal surface of the sleeve structure; and a plurality of gears, each gear of the plurality of gears coupled to an output shaft of a respective motor of the plurality of motors and engaging with a portion of the plurality of gear teeth of the internal gear element to transmit rotation from the plurality of motors to the sleeve structure.

Clause 11. The tubing hanger orientation assembly of any of clauses 8-10, wherein the rotary actuator is operable to provide a full 360 degree range of rotation between the sleeve structure and the internal joint structure.

Clause 12. The tubing hanger orientation assembly of any of clauses 8-11, further comprising: a slip joint structure comprising a hydraulic slip ring operable to transmit hydraulic power from the internal joint structure to the sleeve structure.

Clause 13. The tubing hanger orientation assembly of any of clauses 8-12, further comprising: a rotary encoder disposed on the slip joint structure, the rotary encoder operable to detect rotation of the sleeve structure with respect to the internal joint structure.

Clause 14. The tubing hanger orientation assembly of any of clauses 8-13, wherein the brake comprises a plurality of brake pistons that, when engaged, extend to interface with the portion of the BOP to prevent rotation of the sleeve structure with respect to the BOP.

Clause 15. The tubing hanger orientation assembly of any of clauses 8-14, further comprising: an alignment slot disposed on the sleeve structure, the alignment slot comprising a vertically elongated opening; and an alignment pin disposed on the internal joint structure, wherein, when the alignment pin is engaged, the alignment pin extends into the alignment slot to prevent rotation of the sleeve structure with respect to the internal joint structure but allow vertical adjustment.

Clause 16. A tubing hanger orientation assembly for coupling a tubing hanger assembly to a wellhead, the tubing hanger orientation assembly comprising: an internal joint structure operable to be placed within an internal bore of a blowout preventer (BOP) associated with the wellhead; a sleeve structure disposed around the internal joint structure, the sleeve structure including an internal gear element with a plurality of gear teeth disposed along an internal surface of the sleeve structure; a rotary actuator that interfaces with the internal gear element of the sleeve structure, the rotary actuator operable to drive rotation of the sleeve structure with respect to the internal joint structure; a BOP pin receiving structure that interfaces with a BOP pin of the BOP, thereby providing a reaction point for rotation of the internal joint structure with respect to the BOP; and at least one orientation sensor operable to measure a rotational orientation of the tubing hanger assembly.

Clause 17. The tubing hanger orientation assembly of clause 16, further comprising: at least one bearing that rotatably couples the sleeve structure to the internal joint structure.

Clause 18. The tubing hanger orientation assembly of any of clauses 16-17, further comprising: an internal brake element that prevents vertical motion of the tubing hanger orientation assembly.

Clause 19. The tubing hanger orientation assembly of any of clauses 16-18, further comprising: an intermediate brake element that prevents motion of the sleeve structure with respect to the internal joint structure.

Clause 20. The tubing hanger orientation assembly of any of clauses 16-19, wherein the rotary actuator comprises: four evenly spaced hydraulic motors that interface with the internal gear element of the sleeve structure to provide rotation of the sleeve structure with respect to the internal joint structure within a full 360 degree range of rotation.

High torque tubing hanger orientation techniques are described in U.S. patent application Ser. No. 18/906,512, titled "HIGH TORQUE ACTUATED TUBING HANGER ORIENTATION", filed Oct. 4, 2024, which is hereby incorporated by reference in its entirety into the present disclosure. The subject matter of which may be combined with the subject matter of the present disclosure. For example, one or embodiments, features, structures, acts, etc. described in the foregoing U.S. patent application may be combined with one or more embodiments, features, structures, acts, etc. described in the present disclosure.

Although the present disclosure has been described with reference to the embodiments illustrated in the attached drawing figures, it is noted that equivalents may be employed and substitutions made herein without departing from the scope of the present disclosure as recited in the claims.

Having thus described various embodiments of the present disclosure, what is claimed as new and desired to be protected by Letters Patent includes the following:

1. A tubing hanger orientation assembly for coupling a tubing hanger assembly to a wellhead, the tubing hanger orientation assembly comprising:

an internal joint structure operable to be placed within an internal bore of a blowout preventer (BOP) associated with the wellhead;

a sleeve structure disposed around the internal joint structure;

a rotary actuator that interfaces with the sleeve structure, the rotary actuator operable to drive rotation of the sleeve structure with respect to the internal joint structure;

a coupling component operable to lock the sleeve structure to the internal joint structure such that rotation of the sleeve structure with respect to the internal joint structure is prevented;

a reaction point that interfaces with the BOP for rotation of the internal joint structure with respect to the BOP; and at least one orientation sensor operable to measure a rotational orientation of the tubing hanger assembly.

2. The tubing hanger orientation assembly of claim 1, wherein the sleeve structure comprises an internal gear element with a plurality of gear teeth disposed along an internal surface of the sleeve structure, and wherein the rotary actuator comprises a hydraulic motor.

3. The tubing hanger orientation assembly of claim 2, further comprising:

a gear coupled to an output shaft of the hydraulic motor, wherein the gear engages with at least a portion of the plurality of gear teeth of the internal gear element such that the sleeve structure is rotated responsive to actuation of the hydraulic motor.

4. The tubing hanger orientation assembly of claim 1, further comprising:

a vertically elongated keyway disposed on the tubing hanger orientation system, the vertically elongated keyway operable to maintain a heading of the tubing hanger during vertical stroking of the tubing hanger orientation assembly.

5. The tubing hanger orientation assembly of claim 1, further comprising:

a rotary encoder disposed on the sleeve structure and operable to detect rotation of the sleeve structure with respect to the internal joint structure.

6. The tubing hanger orientation assembly of claim 5, wherein the at least one orientation sensor comprises a gyroscopic sensor.

7. The tubing hanger orientation assembly of claim 6, wherein rotary actuator is driven based at least in part on a signal from the at least one orientation sensor and the rotary encoder.

8. A tubing hanger orientation assembly for coupling a tubing hanger assembly to a wellhead, the tubing hanger orientation assembly comprising:

an internal joint structure operable to be placed within an internal bore of a blowout preventer (BOP) associated with the wellhead;

a sleeve structure disposed around the internal joint structure;

a rotary actuator that interfaces with the sleeve structure, the rotary actuator operable to drive rotation of the sleeve structure with respect to the internal joint structure;

a coupling component operable to lock the sleeve structure to the internal joint structure such that rotation of the sleeve structure with respect to the internal joint structure is prevented;

a brake disposed on the sleeve structure, the brake operable to interface with a portion of the BOP; and at least one orientation sensor operable to measure a rotational orientation of the tubing hanger assembly.

9. The tubing hanger orientation assembly of claim 8, wherein the rotary actuator comprises a plurality of motors disposed within a portion of the internal joint structure.

10. The tubing hanger orientation assembly of claim 9, further comprising:

an internal gear element including a plurality of gear teeth disposed along an internal surface of the sleeve structure; and a plurality of gears, each gear of the plurality of gears coupled to an output shaft of a respective motor of the plurality of motors and engaging with a portion of the plurality of gear teeth of the internal gear element to transmit rotation from the plurality of motors to the sleeve structure.

11. The tubing hanger orientation assembly of claim 10, wherein the rotary actuator is operable to provide a full 360 degree range of rotation between the sleeve structure and the internal joint structure.

12. The tubing hanger orientation assembly of claim 8, further comprising:

a slip joint structure comprising a hydraulic slip ring operable to transmit hydraulic power from the internal joint structure to the sleeve structure.

13. The tubing hanger orientation assembly of claim 12, further comprising:

a rotary encoder disposed on the slip joint structure, the rotary encoder operable to detect rotation of the sleeve structure with respect to the internal joint structure.

14. The tubing hanger orientation assembly of claim 8, wherein the brake comprises a plurality of brake pistons that, when engaged, extend to interface with the portion of the BOP to prevent rotation of the sleeve structure with respect to the BOP.

15. The tubing hanger orientation assembly of claim 8, further comprising:

an alignment slot disposed on the sleeve structure, the alignment slot comprising a vertically elongated opening; and an alignment pin disposed on the internal joint structure, wherein, when the alignment pin is engaged, the alignment pin extends into the alignment slot to prevent rotation of the sleeve structure with respect to the internal joint structure but allow vertical adjustment.

16. A tubing hanger orientation assembly for coupling a tubing hanger assembly to a wellhead, the tubing hanger orientation assembly comprising:

an internal joint structure operable to be placed within an internal bore of a blowout preventer (BOP) associated with the wellhead;

a sleeve structure disposed around the internal joint structure, the sleeve structure including an internal gear element with a plurality of gear teeth disposed along an internal surface of the sleeve structure;

a rotary actuator that interfaces with the internal gear element of the sleeve structure, the rotary actuator operable to drive rotation of the sleeve structure with respect to the internal joint structure;

a BOP pin receiving structure that interfaces with a BOP pin of the BOP, thereby providing a reaction point for rotation of the internal joint structure with respect to the BOP; and at least one orientation sensor operable to measure a rotational orientation of the tubing hanger assembly.

17. The tubing hanger orientation assembly of claim 16, further comprising:

at least one bearing that rotatably couples the sleeve structure to the internal joint structure.

18. The tubing hanger orientation assembly of claim 16, further comprising:

an internal brake element that prevents vertical motion of the tubing hanger orientation assembly.

19. The tubing hanger orientation assembly of claim 18, further comprising:

an intermediate brake element that prevents motion of the sleeve structure with respect to the internal joint structure.

20. The tubing hanger orientation assembly of claim 16, wherein the rotary actuator comprises:

four evenly spaced hydraulic motors that interface with the internal gear element of the sleeve structure to provide rotation of the sleeve structure with respect to the internal joint structure within a full 360 degree range of rotation.

* * * * *